United States Patent [19]

Dobrez et al.

[11] 4,357,243

[45] Nov. 2, 1982

[54] METAL-WORKING EMULSION RECLAIMING PROCESS

[75] Inventors: John F. Dobrez, Flossmoor; Jose T. Jacob, Lake Zurich, both of Ill.

[73] Assignee: Dober Chemical Corporation, Midlothian, Ill.

[21] Appl. No.: 207,232

[22] Filed: Nov. 17, 1980

[51] Int. Cl.[3] ..... C10M 11/00

[52] U.S. Cl. ..... 210/752; 210/764; 210/765; 210/766; 252/49.5

[58] Field of Search ..... 208/179, 183; 210/702, 210/708, 712, 723, 724, 726, 737, 738, 749, 765, 766, 774, 752, 764; 252/49.5

[56] References Cited

U.S. PATENT DOCUMENTS

| | | | |
|---|---|---|---|
| 2,902,439 | 9/1959 | Milz et al. | 208/183 |
| 3,365,397 | 1/1968 | Kolarik | 252/49.5 |
| 3,726,799 | 4/1973 | McDole et al. | 252/49.5 |
| 3,790,474 | 2/1974 | Moffitt | 208/183 |
| 4,256,578 | 3/1981 | Kozar | 210/766 |
| 4,293,424 | 10/1981 | Baur et al. | 210/737 |

FOREIGN PATENT DOCUMENTS

| | | | |
|---|---|---|---|
| 50-70389 | 5/1980 | Japan | 210/708 |

*Primary Examiner*—Peter A. Hruskoci

[57] ABSTRACT

A method for reclaiming an aqueous emulsion useful as a metal-working lubricant/coolant which is contaminated with particles of at least one metal comprises contacting the contaminated emulsion with at least one metal solubilizing agent at metal solubilizing conditions to solubilize at least a portion of the metal particles. The thus contacted emulsions have improved suitability as a metal-working lubricant/coolant relative to the contaminated emulsion.

16 Claims, No Drawings

METAL-WORKING EMULSION RECLAIMING PROCESS

BACKGROUND AND SUMMARY OF THE INVENTION

This invention relates to an improved method for extending the useful life of aqueous emulsions useful as metal-working lubricants/coolants. More particularly, this invention relates to an improved method for reclaiming aqueous emulsions which have become contaminated with solid metal particles, e.g., during use as metal-working lubricants/coolants.

It is customary and conventional to use a lubricant and/or coolant composition while working metal. Among the metal-working operations in which such compositions are normally used are cutting, grinding, drilling, drawing, ironing, boring, broaching, milling, metal shaping, bending and the like. Among the lubricant/coolant compositions used in these metal-working operations are aqueous emulsions, for example, emulsions comprising oil (including synthetically derived oil) and water.

During use, these emulsions often become contaminated with solid particles of the metal being worked. Such particles can become abrasive and actually interfere with the metal-working operation. For example, an emulsion used as a lubricant/coolant in an aluminum drawing operation e.g., to produce aluminum beverage cans becomes contaminated with aluminum particles which can cause defects in the aluminum article being produced. Filtering systems have been suggested to remove these metal particles. However, these systems have been largely ineffective, particularly when the metal particles are exceedingly small, e.g., about 0.5 to about 5.0 microns.

Another problem with such emulsions is that upon being recycled continuously over a period of time the emulsions are attacked by bacteria and other microbes which give the emulsion a very unpleasant odor.

Biocides have been employed in the past in an attempt to correct this problem. However, these biocidic materials add to the expense of the metal-working operation and, often require relatively sophisticated monitoring and control equipment to maintain the concentration desired.

Eventually, because of one or both of these problems, the emulsion is removed from service and is either discarded or reprocessed, using relatively complex and expensive techniques to reclaim, for example, the oil part of the emulsion.

Therefore, one object of the present invention is to provide an improved method for reclaiming an aqueous emulsion which has been contaminated with metal particles.

Another object of the present invention is to provide such a method and obtain an emulsion useful as a metal-working lubricant/coolant.

An additional object of the present invention is to provide an improved method of treating an aqueous emulsion to reduce the microbe activity in the emulsion.

A still further object of the present invention is to provide an improved method of metal-working. These and other objects of the present invention will become apparent hereinafter.

DESCRIPTION OF THE INVENTION

An improved method for reclaiming aqueous emulsions has now been discovered. Such emulsions, which in the uncontaminated state, are useful as metal-working lubricants and/or coolants, are contaminated with particles of at least one metal. Such contamination can occur, for example, during use of the emulsion as a metal-working lubricant and/or coolant. The present method comprises contacting the metal-contaminated emulsion with at least one metal solubilizing agent at metal solubilizing conditions to solubilize at least a portion, preferably at least a major portion by weight of the solid particles. After this contacting, the emulsions which dissolved metals contained therein, have been found to be useful as metal-working lubricants and/or coolants.

The present method is particularly effective when the metal particles are particles selected from the group of aluminum, iron, tin and mixtures thereof. More preferably, the metal particles are aluminum.

Preferably, the metal solubilizing agent comprises at least one basic material. The term "basic material" as used herein refers to a material having the capability of raising the pH of water when introduced into the water. If a basic material is employed, it is preferred that such contacting occur such that the aqueous portion of the emulsion is at a pH in the range of about 9 to about 13.5, more preferably, in the range of about 10 to about 13.5. After the contacting with basic material, the emulsion is preferably further contacted with at least one acidic material to adjust the pH of said emulsion to a level so that the emulsion has improved suitably as a metal-working lubricant/coolant. The term "acidic material" as used herein refers to a material capable of reducing the pH of water when introduced into the water.

Although any type of aqueous emulsion suitable as a metal working lubricant and/or coolant may be processed according to the present invention, emulsions comprising oil and water are preferred.

Typical examples of oils suitable for use in the present oil-water emulsions are hydrocarbon-based materials. Although mineral oils or combinations of naturally occurring (e.g., petroleum) hydrocarbons and synthetically derived materials may be used, synthetically derived materials, and in particular polyolefin, more particularly polybutene, based materials are preferred. Suitable hydrocarbon-based materials include petroleum mineral oils, such as refined coastal oils and refined mid-continent oils. The petroleum oils, may be refined by acid treatment, solvent extraction, hydrogenation and other procedures. Although oils of widely varying viscosities can be used in the oil-water emulsions involved in the present invention, it is preferred to use an oil with a viscosity in the range of about 30 to about 1200 SUS at 100° F., more preferably about 30 to about 150 SUS at 100° F.

The polyolefins preferred for use in the oil-water emulsions include those which are conventional and well known in the art. Preferably, these materials are homopolymers and copolymers of olefins containing 2 to about 12 carbon atoms per molecule such as, for example, ethylene, propylene, butylene and the like. Such polyolefins may be produced using conventional and well known techniques. See, for example, U.S. Pat. No. 3,298,954.

As noted above, one particularly preferred hydrocarbon-based material for use in oil-water emulsions is polybutenes. Such emulsions give especially outstanding results when used as lubricants/coolants in aluminum working operations. Suitable polybutenes include commercially available products and may be produced, for example, by polymerizing butylene from a butane-butylene stream, e.g., as described in U.S. Pat. Nos. 2,407,873; 2,677,000; 2,677,001; and 2,677,002.

The hydrocarbon-based material or oil may include (as an integral part of its molecular structure) minor, non-interferring amounts of non-hydrocarbon substituents such as, sulfur, halogen, oxygen, nitrogen, phosphorus mixtures thereof and the like. The term "non-interferring" as used in the context of this paragraph means the presence of one or more substituents in amounts which do not cause a substantial detrimental loss in the capability of the oil-water emulsion both before and after being processed according to the present method to perform as a metal-working lubricant and/or coolant.

The aqueous emulsions processed according to the present method preferably include about 40% to about 99.5%, more preferably about 50% to about 98% and still more preferably about 60% to about 95%, by volume of water, based on the total emulsion. Of course, these emulsions may also include minor, effective amounts of one or more additives to provide the emulsions with one or more specific properties. Such additives may include, for example, emulsifiers, extreme pressure agents, coupling agents, biocides (meaning to include also bactericides), corrosion inhibitors, rust inhibitors and the like conventionally employed in such aqueous emulsions. Such additives may become spent, i.e., lose effectiveness, as the emulsion is used over a period of time. Since the present method prolongs the useful life of such aqueous emulsions in one preferred embodiment of the present invention the emulsion containing solubilized metal particles is combined with one or more additive materials, e.g., conventional additive materials, to improve at least one property of the emulsion. Thus, after the emulsion has been processed to solubilize at least a portion of the contaminating metal particles, one or more additive materials may preferably be combined with the emulsion to improve its capability to perform as a metal-working lubricant and/or coolant over a prolonged period of time made possible by the method of the present invention. In certain instances, the reprocessed emulsions preferably are passed through equipment, e.g., colloid mill and the like, to improve the stability of the reprocessed emulsion. Also, at least one additive material capable of complexing with at least a portion of the solubilized metal may preferably be added to or combined with the reprocessed emulsion.

As noted above, the metal particles contaminated emulsion is preferably contacted with at least one basic material. Any basic material, as defined above, or combination of such materials that is useful in effecting the metal particles solubilization without substantially detrimentally affecting the functionality of the aqueous emulsion (as a metal-working lubricant and/or coolant) may be used in the present method. The solubilized metal containing emulsion will not have suffered a substantial detriment to its functionality if one or more additive materials are to be combined with the emulsion to improve its effectiveness, as described above.

The preferred basic materials for use in the present invention include alkali metal hydroxides, alkali metal hydrides, alkali metal oxides, ammonium hydroxide, basic salts of phosphoric and boric acids and mixtures thereof. The more preferred basic materials for use in the present invention are alkali metal hydroxides, ammonium hydroxide and mixtures thereof. The term "alkali metal" as used herein refers to metals including lithium, sodium and potassium.

The contaminated emulsion is preferably contacted with at least one basic material at a temperature in the range of about 60° F. to about 180° F., more preferably in the range of about 140° F. to about 180° F. and for a time in the range of about 0.1 hour to about two hours, more preferably in the range of about 0.2 to about 1.5 hours. This contacting provides an additional benefit. At least a portion of the bacteria and other microbes which grow in the emulsion during use are eliminated by the above processing. In effect, the above processing at least partially sterilizes the emulsion, thus reducing or eliminating the need for additional biocide to be included in the emulsion.

The amount of solubilizing agent, e.g., basic material utilized in the present method depends, for example, on the amount of metal particles present in the contaminated emulsion, the elemental identity of the contaminating metal or metals, and the degree of solubilization desired. When, as is preferred, substantially all of the contaminating metal particles are desired to be solubilized, it is preferred to contact the contaminated emulsion with an amount of at least one basic material in the range of 1 to about 2, more preferably 1 to about 1.5, times the amount of such basic material theoretically needed to chemically react with all the contaminating metal particles present to form water-soluble, metal containing entities. The use of excessive amounts of basic materials is to be avoided as wasteful. Such excessive basic materials often require neutralization before the emulsion can be returned to service as a metal-working lubricant/coolant.

In certain instances, e.g., aluminum contaminated, polybutene based emulsions, the solubilization conditions, in particular the pH level, are such that the emulsion is further contacted with at least one acidic material (as defined previously) to adjust the pH of the emulsion so that the emulsion (containing solubilized metal) has improved suitability for use as a metal-working lubricant and/or coolant. Any acidic material or combination of such materials that is useful in lowering the pH of the emulsion without substantially detrimentally affecting the functionality of the oil-water emulsion (as a metal-working lubricant and/or coolant) may be used in the present method.

The preferred acidic materials for use in the present invention include sulfuric acid, sulfamic acid, hydrochloric acid, nitric acid, organic acids containing from 1 to about 24 carbon atoms per molecule and mixture thereof. The more preferred acidic materials for use in the present invention are sulfuric acid, hydrochloric acid, nitric acid, formic acid, acetic acid, hydroxy acetic acid, glucomic acid and mixtures thereof.

The amount of acid material or materials utilized in the present method depends, for example, on the amount, if any, of excessive basic material present and the final pH value desired for the emulsion.

The organic acids useful in the present invention contain 1 to about 24, more preferably 1 to about 8 carbon atoms per molecule. Such acids include, for example, the well known, saturated and unsaturated mono-, di-, and poly-carboxylic acids. Examples of such acids include formic acid, acetic acid, propanoic acid, hydroxy acetic acid, glucomic acid, oleic acid and the like. Organic acids which are particularly preferred for use in the present invention are selected from the group consisting of formic acid, gluconic acid and mixtures thereof.

The aqueous emulsions after being processed according to the present invention may be used as metal-working lubricants and/or coolants, e.g., in a manner similar to that in which the virgin, or uncontaminated, emulsion was used. Such aqueous emulsions may be used by maintaining, or causing to be maintained a lubricating and/or cooling amount of the composition on the metal surface being worked. In many instances, these aqueous emulsions are circulated over a period of time in a system which may include heat exchange, filter apparatus and the like in addition to the operation station at which the emulsion is actually used as a metal-working lubricant and/or coolant. Of course, the entire inventory of emulsion can be subjected to the present invention to prolong the useful life of the emulsion. An alternate mode of practicing the present invention in conjunction with such circulating systems is to substantially continuously subject a given portion of the total emulsion inventory to the present method to effectively maintain a desired and acceptable level or concentration of metal particles in the emulsion inventory. In this mode of operation new virgin emulsion is preferably substantially continuously added, e.g., once or twice a day additions to the inventory to replace that portion of the emulsion inventory which is consumed and/or withdrawn.

In any event, one important benefit of the present invention is that metal contaminated emulsions can be cleaned on site of the metal-working operation and without requiring transport to some centralized reprocessing operation where, in effect, the emulsion is broken down using relatively complex and expensive techniques and only the hydrocarbon based material is reclaimed. In contrast, the present method allows for simple, on site processing and reclaiming of aqueous emulsions useful as metal-working lubricants and/or coolants.

The following examples illustrate certain embodiments of the present invention. However, these illustrations are not to be interpreted as specific limitations on the invention.

EXAMPLE I

The oil-water emulsion selected for testing was based on a commercially available material sold to be useful when emulsified with water as a lubricant for two piece aluminum can production. This commercially available material itself comprised a major amount by weight of commercially available polybutene and minor amounts of conventional emulsifiers, corrosion and rust inhibitors, and an anti oxident. This material, sold commercially under the Tradename DR-1C by Dober Chemical Corporation, was combined with water into an emulsion containing 90% by volume water and was used effectively as a lubricant in a commercial two piece aluminum can production operation. This operation involved aluminum drawing and aluminum ironing. The virgin emulsion had a light creamy color.

After a period of time in use, the emulsion became unacceptably contaminated with fine particles of aluminum. At this point the emulsion was a dirty gray color. The emulsion was unacceptable in that these aluminum particles in the emulsion were having an adverse effect on the tool being used and on the finish or quality of the aluminum cans being produced. Also, the contaminated emulsion gave off an odor indicative of bacteria presence and growth.

Sodium hydroxide, in the form of an aqueous solution containing 50% by volume of NaOH, was added to the emulsion to bring the pH of the emulsion up to 13. The emulsion was heated to 160° F. and maintained at this temperature for 20 minutes. Throughout this processing the emulsion was stirred to insure mixing. During this processing, the emulsion changed from grayish dirty in color to a light cream color. In addition, the unpleasant microbe related odor of the contaminated emulsion had been eliminated.

After cooling the emulsion, sulfuric acid was added to readjust the pH of the emulsion to 8.

The resultant light, creamy emulsion was tested in the laboratory using a test, identified as ANA/ASTM-2716, which is known to be a reasonable screening tool to determine the suitability of any particular emulsion as a metal-working lubricant and/or coolant.

Briefly, this test involved applying a force to a piece of aluminum on which is the emulsion to be tested. The force, or load, is moved across the aluminum piece and a scar is formed in the aluminum. Various measurements and determinations are made to determine the efficacy of the emulsion as a lubricant.

The results of the above noted test for the reprocessed emulsion were compared with those for the virgin or fresh emulsion. These results were as follows:

| PRODUCT | FRICTION FORCE FT/Lbs | COEFFICIENT OF FRICTION | SCAR WIDTH, M M |
|---|---|---|---|
| Fresh Emulsion | 6.0 | 0.039 | 3 |
| Emulsion Reprocessed as per present invention | 5.9 | 0.0393 | 3 |

These results indicate that the reprocessed emulsion has substantially the same lubrication characteristics as the fresh emulsion which is known to be suitable as a lubricant for two piece aluminum can production. Thus, these results indicate that the emulsion reprocessed according to the present invention is useful as a lubricant for two piece aluminum can production.

EXAMPLE II

The emulsion reprocessed as in Example II is used in a commercial two piece aluminum can production operation. This emulsion performs satisfactorily as a lubricant in this operation.

EXAMPLE III

Example I is repeated except that ammonium hydroxide are used instead of sodium hydroxide, and formic acid is used in place of sulfuric acid.

The resulting emulsion is light, creamy in color and is substantially free of odor indicating the presence of microbes. This emulsion performs satisfactorily as a lubricant in a commercial two piece aluminum can production operation.

The present invention is seen to provide a simple, effective method for reclaiming and reusing aqueous emulsions which have become contaminated by metal particles. This reclaiming method can be conveniently practiced on site at the metal-working operation and does not require transportation back to a reclaimer or complex processing. In addition, both the oil and water portions of the emulsion are reclaimed for reuse. An additional feature of this invention is that when the preferred basic materials are utilized, the reprocessed emulsion has a reduced concentration of bacteria and other microbes. Further, the aqueous emulsions reprocessed according to the present invention are surprisingly usable as metal-working lubricants and/or coolants.

While in the foregoing disclosure certain examples have been set forth which illustrate details specifying modes of applying this invention, it should be understood that such details may be varied considerably by one skilled in the art without departing from the spirit of this invention.

The embodiments of the invention in which an exclusive property or privilege is claimed are defined as follows:

1. A method for reclaiming an aqueous emulsion contaminated with particles of at least one metal selected from the group consisting of aluminum, iron, tin, and mixtures thereof, which contaminated emulsion includes about 40% to about 99.5% by volume of water and in the uncontaminated state is useful as a metal-working lubricant, said method comprising contacting said contaminated emulsion with at least one added basic material at metal solubilizing conditions including a temperature in the range of about 60° F. to about 180° F. and a pH of the aqueous portion of said contaminated emulsion in the range of about 9 to about 13.5 for a period of time not greater than about 2 hours to solubilize at least a portion of said metal particles, and contacting said emulsion with at least one acidic material to adjust the pH of said emulsion to a level so that said emulsion is suitable for use as said metal-working lubricant.

2. The method of claim 1 wherein said aqueous emulsion comprises an oil-water emulsion.

3. The method of claim 2 wherein said emulsion is contaminated by aluminum particles.

4. The method of claim 3 wherein said basic material is selected from the group consisting of alkali metal hydroxides, alkali metal hydrides, alkali metal oxides, ammonium hydroxide, basic salts of phosphoric and boric acids and mixtures thereof.

5. The method of claim 3 wherein said contacting solubilizes substantially all of said aluminum particles.

6. The method of claim 2 wherein at least a portion of said oil in said oil-water emulsion is synthetically derived.

7. The method of claim 6 wherein at least a portion of said oil in said oil-water emulsion is polybutene.

8. The method of claim 7 wherein said basic material is selected from the group consisting of alkali metal hydroxides, alkali metal hydrides, alkali metal oxides, ammonium hydroxide, basic salts of phosphoric and boric acids and mixtures thereof.

9. The method of claim 8 wherein said acidic material is selected from the group consisting of sulfuric acid, sulfamic acid, hydrochloric acid, nitric acid, organic acids containing from 1 to about 24 carbon atoms per molecule and mixtures thereof.

10. The method of claim 9 wherein said basic material is selected from the group consisting of alkali metal hydroxides, ammonium hydroxide and mixtures thereof, and said acidic material is selected from the group consisting of sulfuric acid, hydrochloric acid, nitric acid, acetic acid, formic acid, hydroxy acetic acid, gluconic acid and mixtures thereof.

11. The method of claim 10 wherein said contaminated emulsion is contacted with said basic material for a period of time in the range of about 0.1 hour to about 2 hours.

12. The method of claim 11 wherein said contacting solubilizes substantially all of said aluminum particles.

13. The method of claim 1 wherein said contaminated emulsion is contacted with said basic material for a period of time in the range of about 0.1 hour to about 2 hours.

14. The method of claim 1 wherein said emulsion containing solubilized metal particles is combined with at least one additive material to improve at least one property of said emulsion.

15. The method of claim 14 wherein at least one said additive material is an agent capable of complexing with at least a portion of said solubilized metal.

16. The method of claim 15 wherein said solubilized metal comprises aluminum.

* * * * *